US010122076B2

(12) United States Patent
Maas

(10) Patent No.: US 10,122,076 B2
(45) Date of Patent: Nov. 6, 2018

(54) MULTI-BAND ELEMENTARY RADIATING CELL

(71) Applicant: THALES, Courbevoie (FR)

(72) Inventor: Olivier Maas, Gif sur Yvette (FR)

(73) Assignee: THALES, Courbevoie (FR)

( * ) Notice: Subject to any disclaimer, the term of this patent is extended or adjusted under 35 U.S.C. 154(b) by 168 days.

(21) Appl. No.: 15/365,580

(22) Filed: Nov. 30, 2016

(65) Prior Publication Data

US 2017/0170553 A1 Jun. 15, 2017

(30) Foreign Application Priority Data

Dec. 9, 2015 (FR) ..... 15 02559

(51) Int. Cl.

| | |
|---|---|
| ***H01Q 1/38*** | (2006.01) |
| ***H01Q 5/50*** | (2015.01) |
| ***H01Q 1/48*** | (2006.01) |
| ***H01Q 9/04*** | (2006.01) |
| ***H01Q 13/16*** | (2006.01) |
| ***H01Q 21/28*** | (2006.01) |
| ***H01Q 21/30*** | (2006.01) |

(52) U.S. Cl.

CPC ..... *H01Q 1/38* (2013.01); *H01Q 1/48* (2013.01); *H01Q 5/50* (2015.01); *H01Q 9/0407* (2013.01); *H01Q 13/16* (2013.01); *H01Q 21/28* (2013.01); *H01Q 21/30* (2013.01)

(58) Field of Classification Search

CPC ..... H01Q 1/38; H01Q 9/0407; H01Q 13/16

See application file for complete search history.

(56) References Cited

U.S. PATENT DOCUMENTS

2003/0164800 A1 9/2003 Jordan et al.
2006/0208901 A1 9/2006 Kai et al.

FOREIGN PATENT DOCUMENTS

AU 2015 101 429 A4 11/2015
WO 2004/102744 A1 11/2004

OTHER PUBLICATIONS

S. E. Valavan et al., "A Dual Band Quasi-Magneto-Electric Patch Antenna for X-band Phased Array," Proceedings of the 44th European Microwave Conference, Oct. 6-9, 2014, pp. 378-381.

*Primary Examiner* — Graham Smith
(74) *Attorney, Agent, or Firm* — Baker & Hostetler LLP

(57) ABSTRACT

A radiating device operating in two distinct frequency bands, a high frequency band and at least one sub-band of a low frequency band, the device comprises: at least one element of patch type adapted to the high frequency band and linked to a first feed, at least one element of folded slot type, adapted to the low frequency band and linked to a second feed different from the first feed, a filter positioned between the element of patch type and the first feed, configured to filter the sub-band of the low frequency band and to be passing for the high frequency band, and wherein the elements of which it consists are positioned in a surface area of less than or equal to a square of edge $\lambda/2$, where $\lambda$ is the wavelength corresponding to the maximum frequency of the high frequency band.

17 Claims, 10 Drawing Sheets

MULTI-BAND ELEMENTARY RADIATING CELL

CROSS-REFERENCE TO RELATED APPLICATIONS

This application claims priority to foreign French patent application No. FR 1502559, filed on Dec. 9, 2015, the disclosure of which is incorporated by reference in its entirety.

FIELD OF THE INVENTION

The present invention lies in the field of radiating devices designed to operate in two distinct frequency bands. It applies notably to dual-band radiating cells produced using printed technology, and used by electronic scanning radars for airspace monitoring. These radars operate in the S band, and in the band dedicated to IFF applications (the acronym standing for "Identification, Friend or Foe").

BACKGROUND

Electronic scanning radars of the prior art consist of directional antennas produced on the basis of radiating elements, or radiating cells, assembled within an array. Modification of the amplitude and of the phase of each of the radiating elements of the array makes it possible to steer the direction of the radar beam.

The frequencies of interest for aerial monitoring applications are the S band, used for the primary radar, and in particular the sub-band from 2.9 GHz to 3.3 GHz, as well as frequency bands of a few MHz or tens of MHz situated around the frequencies 1.03 GHz and 1.09 GHz, and used for IFF applications. Current radar equipment, whether they be ground-based radars or radars onboard a carrier such as for example a vehicle, a ship or an aeroplane, generally comprise two independent systems: a rotating directional antenna dedicated to IFF applications and an array of radiating cells for the S Band radar. The rotary antenna is positioned above or alongside the S band radar antenna. The two volumes are therefore added, and this may pose a problem when transporting or installing the antennas.

The invention seeks to solve the general problematic issue of the proliferation of systems by proposing a radiating cell operating simultaneously and without interference, in two distinct frequency bands, in particular the S Band and the frequency band dedicated to IFF applications. Such a cell makes it possible to produce a dual-band radiating array, thus reducing the footprint of the radar system as a whole, as well as the complexity of installation and the associated usage constraints. The invention proposes a radiating cell for which the feeds to the various frequency bands are independent, thereby making it possible to integrate the invention into existing radar devices in a transparent manner.

The use of dual-band or broadband radiating elements inside radiating arrays is a frequently encountered problem.

It is all the more complex as, when radiating elements are close together, strong coupling phenomena occur. These coupling phenomena are all the more marked when the ratio of the frequencies between the high band and the low band approaches an odd integer. Indeed, the radiating elements are dimensioned with respect to the wavelength at which they operate. An element dimensioned to radiate in the low frequency band will generally have a size close to $\lambda_B/2$, with $\lambda_B$ the maximum wavelength of the low frequency band. On account of the ratio of the frequency bands, its size will also be $N.\lambda_H/2$, with N the ratio of the frequency bands and $\lambda_H$ the maximum wavelength of the high frequency band in the dielectric. Therefore, when N approaches an odd integer, the device also radiates for the high frequency band, thus amplifying the coupling phenomena.

The use, within one and the same radiating cell, of elements that are specific to each of the operating bands and separated by a gap making it possible to minimize the problems of inter-element coupling, is not a solution to the problem when the radiating cell is implemented in a radiating array. Indeed, the size of the cell is constrained by the array mesh size, which generally equals $\lambda/2$, with $\lambda$ the wavelength in air corresponding to the maximum frequency. Thus, when the ratio of frequencies between the high frequency band and the low frequency band increases, the radiating elements required by the low frequency band become incompatible with the size of this array spacing. By way of example, the array spacing of a mesh radiating in the S band at 3.3 GHz is about 5 cm. A patch adapted to the S band, when it is produced within the framework of a substrate having a relative dielectric constant of 3.55, has dimensions of the order of 25 mm×25 mm, compatible with the array spacing. A patch for IFF applications, on account of the frequency ratio of 3 between the two bands, will be 3 times as large (and 9 times bigger in area). Its size will then be 75 mm×75 mm. A device comprising a band S patch and a patch for IFF applications will not therefore be compatible with the radiating mesh size.

Thus, patent application US 2003/0164800 A1 presents a three-band device operating in the AMPS (800-850 MHz), GPS (1.4 GHz) and PCS (1.85-1.99 GHz) bands on the basis of a patch antenna and of two slots. The ratio of the operating frequencies not being odd multiples, the device does not exhibit any means of removing the interference related to the coupling between the radiating elements. Moreover, the use of a slot tuned to the low frequency band renders it incompatible with its integration into a radiating mesh dimensioned with respect to the high frequency.

Australian patent AU 2015101429 A4 presents a dual-band device operating in the Wifi bands at 2.4 GHz and 5 GHz. However, in this device, the ratio of the frequencies is not an odd multiple, it does not therefore exhibit any particular coupling problems. Nor does it exhibit independent feed to each of the frequency bands: the radiating elements associated with each of the frequency bands cannot then be driven independently.

A first known solution to the problem of producing a dual-band cell of reduced dimensions consists in using a single broadband radiating element. Once placed in an array, the result is then a single broadband array, covering all the bands of interest. However, the production of such a radiating element turns out to be complex when the band gap increases, and does not address the need for an independent feed to each of the frequency bands.

To address the problematic issue of the size of the array, a known solution consists in using, for the low frequency band, elements of folded monopole or dipole type, or slots folded in such a way that they can be accommodated in a reduced area. The simultaneous use of a patch for the high frequency band and of a slot for the low frequency band exhibits a practical interest, since the slot can be accommodated in the metallization of the patch, or in that of its ground plane. Diverse solutions of this type have been explored, but they come up against the fact that, under these conditions, radiating slots exhibit a very narrow passband, thereby limiting their interest.

The article "A Dual Band Quasi-Magneto-Electric Patch Antenna for X-band Phased Array", S.E Valavan, Proceedings of the 44th European Microwave Conference 2014, has overridden this limitation by using the phenomena of coupling between the two elements. It proposes to disturb a radiating patch in the high frequency band with the aid of a slot accommodated inside the radiating area of the patch. The response of the device, resulting from the coupling between the two elements, exhibits operation in two distinct frequency bands whose central frequencies are a ratio of 1.5 apart, but having appreciable passbands (greater than 5%).

However, such a device exhibits two major defects:

the band ratio equals 1.5, which does not make it possible to address IFF and S Band radar applications, for which the frequency band ratio equals 3, it does not address the need to have two separate antennas each linked to a distinct feed, since it proposes a coupled system having two resonance bands. The amplitudes and phases of the radiating elements associated with each frequency band cannot then be driven independently. Moreover, the integration of such a cell into existing equipment requires a separation between these two bands, in order to drive the signal in the high and low frequency band separately. This separation requires the production of an additional item of equipment at the interface between the radiating array and the radio equipment. It may turn out to be tricky, the quality of the resulting signals depending on the cleanness of the filtering implemented.

SUMMARY OF THE INVENTION

The invention addresses the problem posed by associating an element radiating in the high frequency band of patch type, with at least one element radiating in the low frequency band of folded slot type. This approach makes it possible to accommodate the two radiating elements in a cell of reduced size, compatible with an array of unitary elements operating at the high frequency, that is to say less than a square of side less than $\lambda_H/2$.

The elements of the high frequency band (patch) and of the low frequency band (slot) are each linked to a distinct feed, thereby enabling them to be driven independently in amplitude and in phase. Filters matched to each of the frequency bands are implemented on each of the feeds, so as to remove the undesirable contributions related to the coupling resulting from the proximity between the radiating elements.

The invention therefore consists of a radiating device operating in two distinct frequency bands, a high frequency band and at least one sub-band of a low frequency band. It is characterized in that it comprises:

at least one element of patch type adapted to the high frequency band and linked to a first feed, at least one element of folded slot type adapted to the low frequency band and linked to a second feed different from the first feed, a filter positioned between the said element of patch type and the said first feed, configured to filter the low frequency band and to be passing for the high frequency band, and in that the elements of which it consists are positioned in a surface area of less than or equal to a square of edge $\lambda/2$, where $\lambda$ is the wavelength corresponding to the maximum frequency of the high frequency band.

Advantageously, the element of slot type is accommodated in a ground plane of the device.

Advantageously, the said element or elements of folded slot type are folded into a U shape and positioned at the periphery of the device.

According to one embodiment of the device, the number of elements of slot type is equal to the number of sub-bands of the low frequency band, the said elements of slot type being powered by one and the same second feed.

According to another embodiment of the device, the number of elements of slot type is equal to the number of sub-bands of the low frequency band, the said elements of slot type being powered by different feeds.

According to another embodiment, the device comprises a single element of slot type powered by the said second feed to which it is linked by a resonator circuit, the coupling between the said slot and the said resonator circuit being adjusted to radiate in two distinct sub-bands of the low frequency band.

Advantageously, in this embodiment, the resonator circuit is a parallel resonator circuit comprising an inductor and a capacitor. The resonator is linked to the element of slot type by a waveguide of length $\lambda/4$, where $\lambda$ is the wavelength associated with the central frequency of the low frequency band.

Advantageously, in all the embodiments, the filter positioned between the element of patch type and the first feed comprises a plurality of segments of microstrip line of different widths.

This property allows it to radiate for only one of the frequency bands when the latter are multiples of one another.

Advantageously, the device furthermore comprises a low-pass filter positioned between the said element or elements of slot type and the said second feed, and configured to filter the high frequency band.

Advantageously, the device furthermore comprises a second element of patch type adapted to the high frequency band, the said second element of patch type being disposed above the said first element of patch type.

The device according to the invention can be implemented in a multilayer printed circuit for which the said element of patch type, the said element or elements of slot type, and the said filter positioned between the element of patch type and the first feed are in different layers of the printed circuit.

This layered distribution makes it possible to limit to the maximum the area of the printed circuit. It is possible since the radiating elements do not mask one another, the element or elements of slot type being positioned at the periphery of the printed circuit, and therefore of the element of patch type.

By virtue of the high frequency band filtering element, the device according to the invention is adapted for operating when at least one frequency of the high frequency band is an odd integer multiple of a frequency of the low frequency band.

The device according to the invention is adapted for operating when the high frequency band comprises the 2.9 GHz-3.3 GHz band.

It is also adapted for operating when at least one sub-band of the low frequency band is centred around a frequency chosen from among the frequency 1030 MHz and the frequency 1090 MHz.

The device according to the invention can readily be produced using printed board technology.

Finally, the invention relates to a radiating array configured to radiate in two distinct frequency bands, and characterized in that it comprises radiating cells in accordance with the radiating device operating in two distinct frequency bands according to the invention.

It is also concerned with an electronic scanning radar configured to operate simultaneously in two different frequency bands, and characterized in that it comprises a radiating array such as described by the invention.

BRIEF DESCRIPTION OF THE DRAWINGS

The invention will be better understood and other characteristics and advantages will become better apparent on reading the nonlimiting description which follows, and by virtue of the appended figures, among which.

DETAILED DESCRIPTION

The descriptions of the embodiments set forth hereinbelow are dedicated to a particular mode of operation of the invention. This mode of operation addresses the needs of radar applications for airspace monitoring. The radiating cell presented hereinafter seeks to operate in a dissociated manner in the 2.9 GHz-3.3 GHz band (sub-band of the S band dedicated to radar applications), as well as in two sub-bands of a few MHz in the frequency band dedicated to IFF applications, a first centred around the frequency 1030 MHz and a second centred around the frequency 1090 MHz. These two sub-bands correspond to the outward and return pathways of IFF applications.

However, the invention is not limited to this manner of operation or to applications of this type, and can be extended mutatis mutandis to other frequency bands, or to other embodiments in which the number of sub-bands chosen inside the low frequency band varies.

In the examples presented, the ratio of the frequency bands, that is to say the ratio between the frequencies of the high frequency band and the frequencies of the low frequency band, equals about three. Therefore, the phenomena of coupling between the diverse radiating elements, introduced by their physical proximity, are reinforced. This is related to the fact that, when the frequency ratio between the bands is an odd integer, all the resonant structures based on lines operate naturally in an identical manner at the frequency $f_0$ and at all its odd multiples. Therefore, the radiating elements dimensioned for IFF applications also radiate for the S band.

Figure 1:
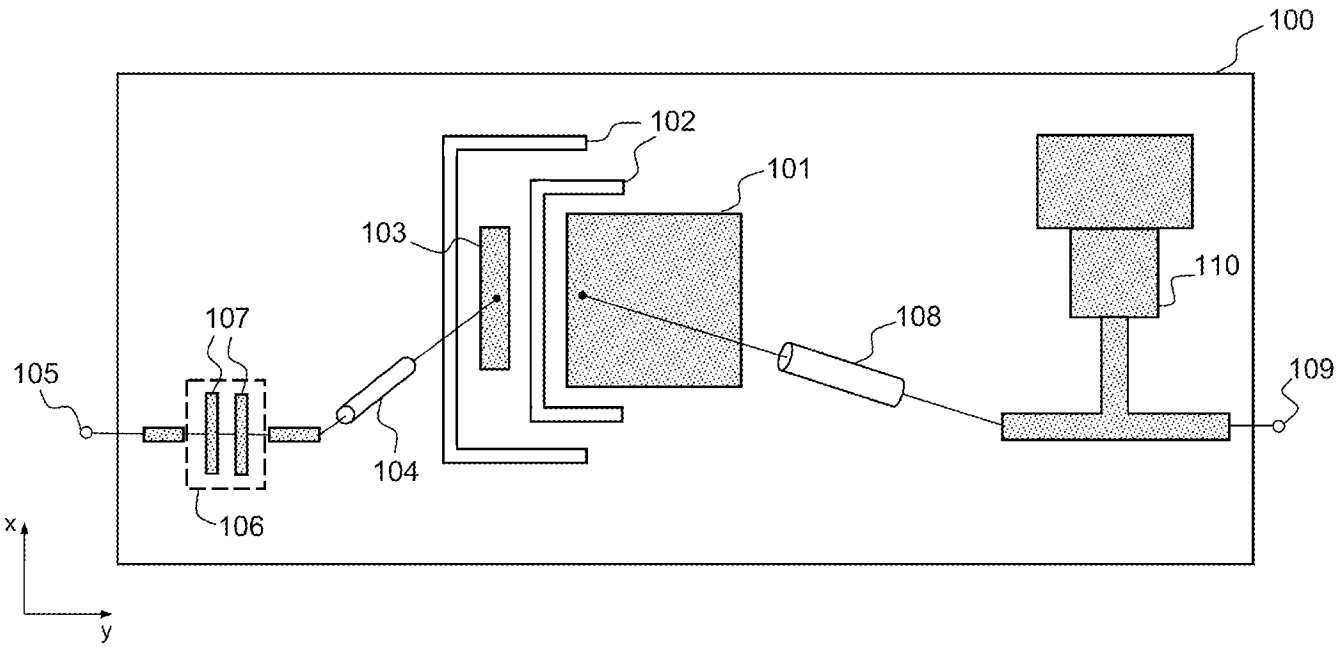
FIG. 1 represents a radiating cell according to a first embodiment of the invention.

FIG. 1 represents a radiating cell according to a first embodiment of the invention. This radiating cell 100, or antenna with printed radiating elements, is a printed circuit comprising multiple layers separated by a dielectric substrate, using distributed elements, that is to say microstrip lines. This technology is very widespread for microwave frequencies since, for the high frequencies, the manipulation of waves on the basis of waveguides is simpler than the manipulation of currents and voltages. One of the layers of the printed circuit forms a ground plane.

The radiating cell comprises a radiating element 101 of patch type. In distributed elements, a patch is a square- or rectangular-shaped powered metallized layer. The dimensions of the patch are chosen so that it radiates in the high frequency band (S band). It is positioned in one of the layers of the circuit.

The radiating cell also comprises two folded radiating slots 102. These slots behave like dipoles, while being less sensitive to coupling phenomena. They are tuned to operate in the vicinity of the sub-bands of interest of the low frequency band (in the example, 1030 MHz and 1090 MHz). This tuning is done by dimensioning each of them with respect to a wavelength close to the wavelength sought, the slot then having a length of $\lambda/2$. In order to slightly decrease the size of the slots, the tuning can be carried out by dimensioning them with respect to a wavelength slightly greater than the wavelength sought, and then by adjusting their relative positions, the position of their exciter, and their position with respect to the patch, so that the coupling phenomena push their operating frequency back to the frequency sought. Within the framework of an IFF/S Band application, it is thus possible to use slots whose length is adapted to an operating frequency of slightly greater than 1100 MHz, thereby rendering them compatible, once folded in three into a U-shape, with a mesh dimensioned with respect to the frequency of 3.3 GHz, and then to push by coupling their operating frequency back to the frequencies of interest 1030 MHz and 1090 MHz by adjusting their positions. The number of slots is adapted to the number of desired low frequency bands. The use of two slots folded in three into a U-shape and of a patch antenna makes it possible to accommodate the three radiating elements in a very restricted environment. It is also possible to fold the slots into more than three to make them fit into the radiating cell according to the invention.

The slots are produced by partial de-metallization of the ground plane of the cell. The excitation of the slots is produced by a radiating strip 103 positioned between the two slots in one of the planes of the printed circuit, preferably the plane adjacent to the ground plane, and linked to the power supply of the slots. The relative positioning of the two slots 102 and of the exciter 103 creates phenomena of couplings, both between the elements of the low frequency band, and also with the patch 101. Their positioning must therefore be adjusted so as to push the artefacts generated by this coupling out of the useful bands. Adjusting the gap between the slots makes it possible to adjust the resonant frequency of each slot and to push their operation back to the triple frequency outside of the high frequency band.

The exciter 103 is powered by the low frequency band feed 105, to which it is linked by a coaxial line 104 and a low-pass filter 106.

This low-pass filter comprises, for example, two capacitors 107, which in printed technology take the form of open line segments. The role of the filter is the filtering of the components of the high frequency band that are due to the strong coupling between the slots and the patch.

The radiating element of patch type 101 is powered by the high frequency band feed 109 to which it is linked by a coaxial line 108 and a filter 110.

The role of the filter 110 is the filtering of the components of the low frequency band that are due to the strong coupling between the slots and the patch.

The production of a high-pass or bandpass filter requires that series capacitors and parallel inductors be strung together, this being difficult to achieve with distributed technology, and wherein the size of the hardware components related to the low frequency band presents the problem of footprint. An alternative way of producing a bandpass filter then consists in inserting one or more short-circuited parallel waveguides, better known as a stub.

A parallel waveguide plays the role of series resonator circuit, and exhibits a very reduced footprint. Its length is proportional to the wavelength in the dielectric of the frequency that it short-circuits. Thus, a stub produced on the basis of a microstrip line segment of length $\lambda_B/4$, with $\lambda_B$ the wavelength of the low frequency band, will play the role of short-circuit in its resonance band. In the example, this is the low frequency band. However, resonant structures based on lines operate naturally in the same manner at the frequency $f_0$ and for all odd multiples of this frequency. Such is the case in the example, where the ratio of the frequency bands is 3. Thus, such a stub will also play the role of short-circuit for the high frequency band.

This problem is solved by implementing a stub whose total length is split up into several segments of different impedances (known by the term "stepped impedance") that can vary. Such a stub is dispersive. It is dimensioned so as to exhibit a short-circuit on its fundamental frequency, and an open circuit on its triple frequency. The filter 110 of FIG. 1 exhibits such a stub, consisting of several segments of microstrip line of different widths, and therefore exhibiting several distinct impedances. In the example, it exhibits three different impedances, but the number of segments is a parameter specific to each implementation. On account of the variable impedances, the system is not homogeneous, its electrical length no longer depends linearly on the frequency. Its size being $\lambda_B/4$, it is tuned so as to block the components in the low frequency band, but is no longer adapted to the electrical length $3.\lambda_H/4$. It then does indeed carry out the sought-after functions of filtering the components of the low frequency band while allowing through the components of the high frequency band.

Figure 2:
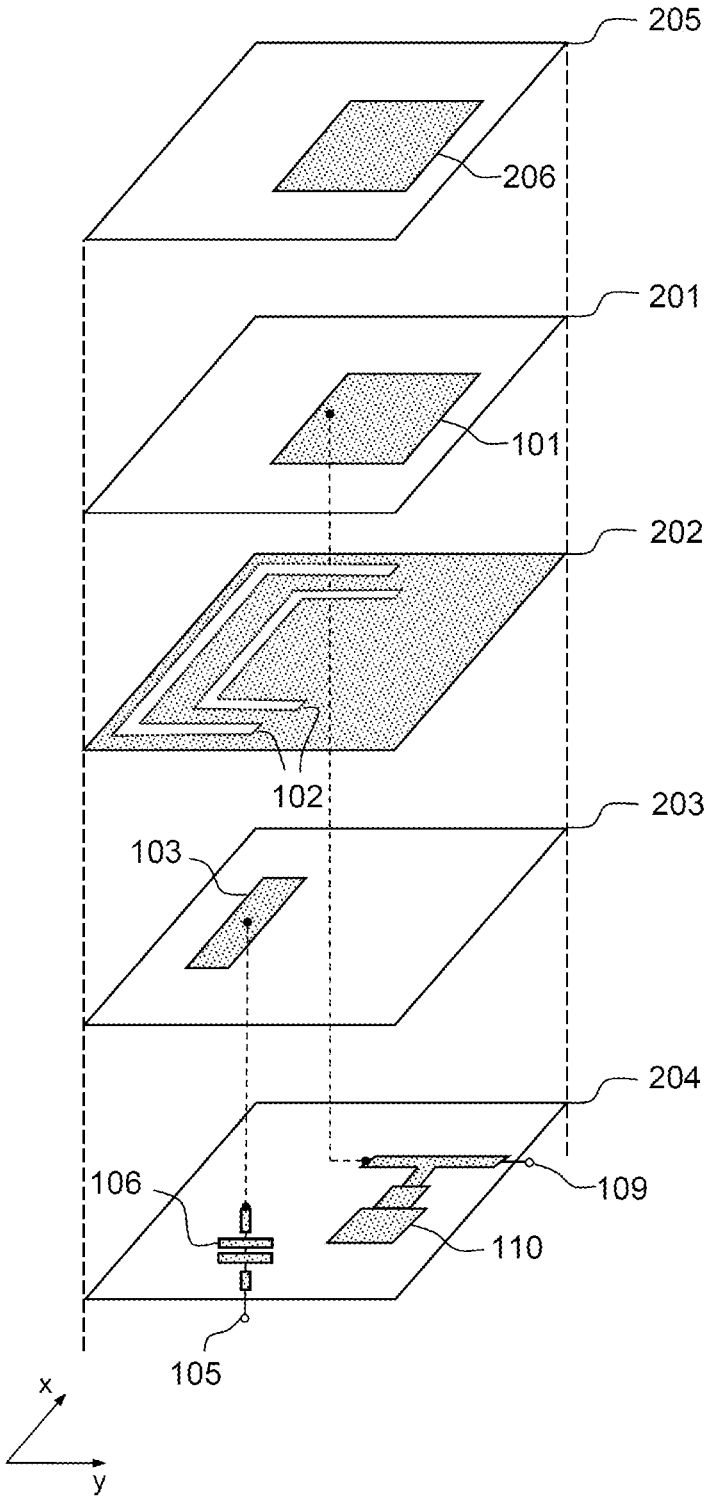
FIG. 2 represents the exploded view of a radiating cell according to the first embodiment of the invention.

The various elements constituting the radiating cell according to the invention are disposed in various layers of the printed circuit. FIG. 2 represents the exploded view of a radiating cell according to the first embodiment of the invention, in which the disposition of the elements is aimed at limiting the size of the radiating cell.

In this nonlimiting example, the printed circuit comprises four layers. Each of the layers comprises a dielectric substrate on which an etched metallic layer is deposited. The upper layer 201 comprises the element of patch type 101 tuned to operate in the high frequency band.

The immediately lower layer 202 comprises the radiating cell's ground plane in which two elements of slot type 102, tuned for the low frequency bands, are produced by demetallization of the ground plane. The slots are disposed so as not to be obstructed by the patch 101. An advantageous positioning then consists in placing them at the periphery of the radiating cell, away from the patch.

The lower layer 203 comprises the exciter of the slots 103. Finally the bottom-most layer 204 comprises the low-pass filtering element 106 linked on the one hand to the feed 105 and on the other hand to the exciter 103 by way of a coaxial line, described under the reference 104 in FIG. 1, allowing it to pass through the various layers of the printed circuit, and the bandpass filtering elements 110 linked on the one hand to the feed 109 and on the other hand to the patch 101 by way of a coaxial line 108.

The resulting radiating cell has a slightly larger format than the format of the S band patch. By way of example, in the specific case of operation for the S band and the IFF applications, the size of the S band patch is 25 mm×25 mm. By using slots dimensioned to operate at 1150 MHz, and then by adjusting the position of the various elements of the device so as to make them radiate in the frequency bands sought, or by using slots adjusted to the IFF frequency bands and folded into more than three parts, the resulting radiating cell of the first embodiment fits into a footprint of 45 mm×45 mm, i.e. $\lambda_H/2\times\lambda_H/2$.

This cell radiates simultaneously in the upper frequency band and in the lower frequency band, but exhibits a separate feed to each of these bands. The various filtering elements make it possible to ensure a strong decoupling between the two feeds.

Advantageously, it is possible to supplement the radiating cell with an additional layer 205, comprising a second patch antenna 206 adapted to the high frequency band. This additional layer is positioned on the highest layer 201, the second patch being overlaid on the first patch 101. This addition makes it possible to increase the passband in the high frequency band, by altering the coupling effects between the two patches, without modifying the size of the cell.

Figure 3A:
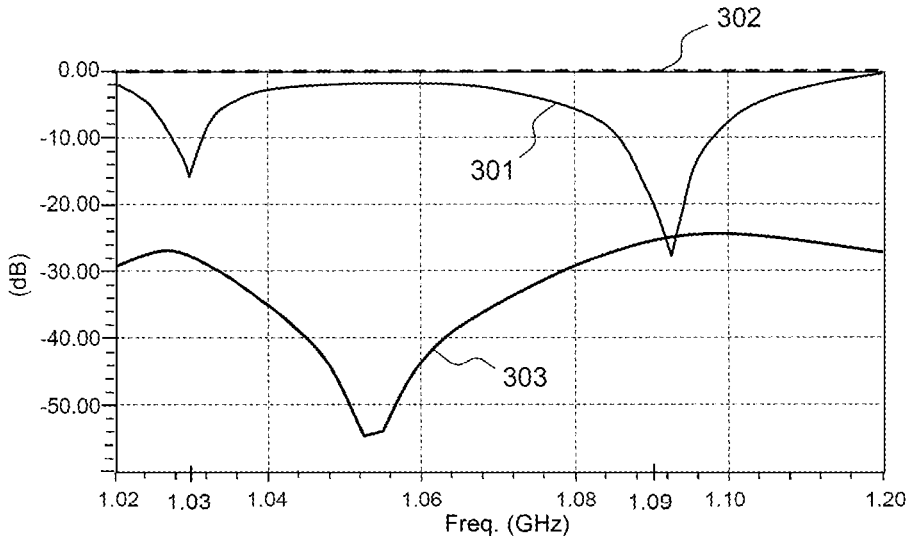
FIGS. 3*a* and 3*b* represent an example of coefficient of reflection of the inputs and of decoupling, respectively in the low frequency band and in the high frequency band and associated with each input of a radiating cell according to the first embodiment of the invention.
Figure 3B:
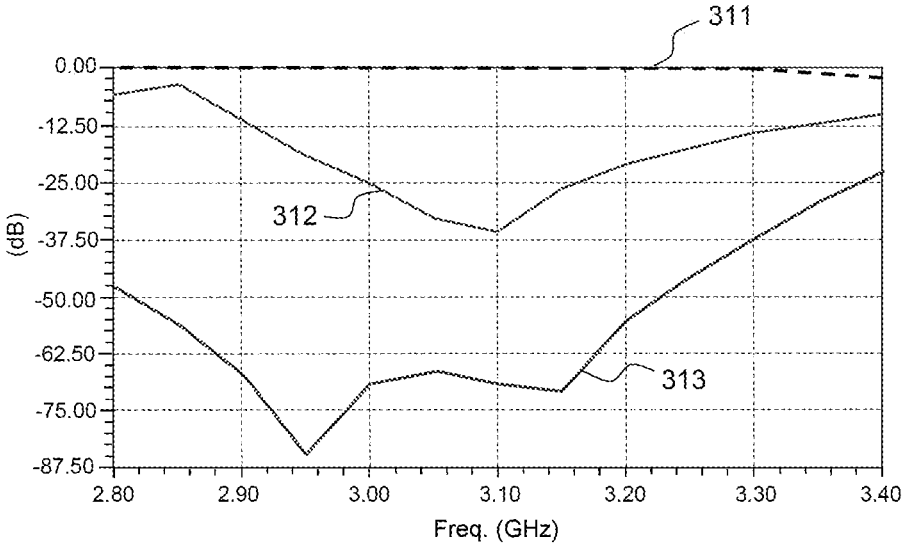

FIGS. 3*a* and 3*b* represent an example of coefficient of reflection of the inputs and of decoupling, respectively in the low frequency band and in the high frequency band and associated with each input of a radiating cell according to the first embodiment of the invention.

The results are obtained by simulations by means of a software package for electromagnetic simulation by the finite element method.

The coefficient of reflection of the inputs is representative of the signal power reflected as a function of frequency. When this coefficient tends to 1 (i.e. 0 dB), then the whole of the power of the signal at the frequency concerned is rejected. The smaller this coefficient, the better the antenna.

The decoupling measures the leakage power in the first antenna when the second antenna is operating and vice versa. It is therefore representative of the performance of coexistence of the two types of radiating elements within the same cell.

In FIG. 3*a*, curve 301 represents the coefficient of reflection of the feed dedicated to the low frequency band, for the low frequency band (the frequency sub-bands envisaged in this embodiment are bands of a few MHz or tens of MHz around the frequencies 1.03 GHz and 1.09 GHz). This coefficient is less than −10 dB around the frequencies 1.03

GHz and 1.09 GHz. The feed dedicated to the low frequency band is therefore adapted to IFF applications.

Curve 302 represents the coefficient of reflection of the feed dedicated to the high frequency band, for the low frequency band. In the 1.02 GHz-1.12 GHz band, this coefficient is constant, and equals 1 (i.e. 0 dB). The feed dedicated to the high frequency band therefore rejects all the components of the low frequency band. It is not affected by the coupling with the radiating elements in the low frequency band. This analysis is confirmed by the measurement of the decoupling 303 between the two inputs, which is greater than 24 dB throughout the band.

In FIG. 3*b*, curve 311 represents the coefficient of reflection of the feed dedicated to the low frequency band, for the high frequency band (the frequency band envisaged in this embodiment is the 2.9 GHz-3.3 GHz band). This coefficient is constant, and equals 1 (that is to say 0 dB). The feed dedicated to the low frequency band therefore rejects all the components of the high frequency band. It is then not affected by the coupling with the radiating elements in the high frequency band.

Curve 312 represents the coefficient of reflection of the feed dedicated to the high frequency band, for the high frequency band. In the 2.9 GHz-3.3 GHz band, this coefficient is less than −12.5 dB. The feed dedicated to the high frequency band is therefore adapted to this frequency band. The decoupling 313 between the two antennas is greater than 25 dB in the band.

Figure 4A:
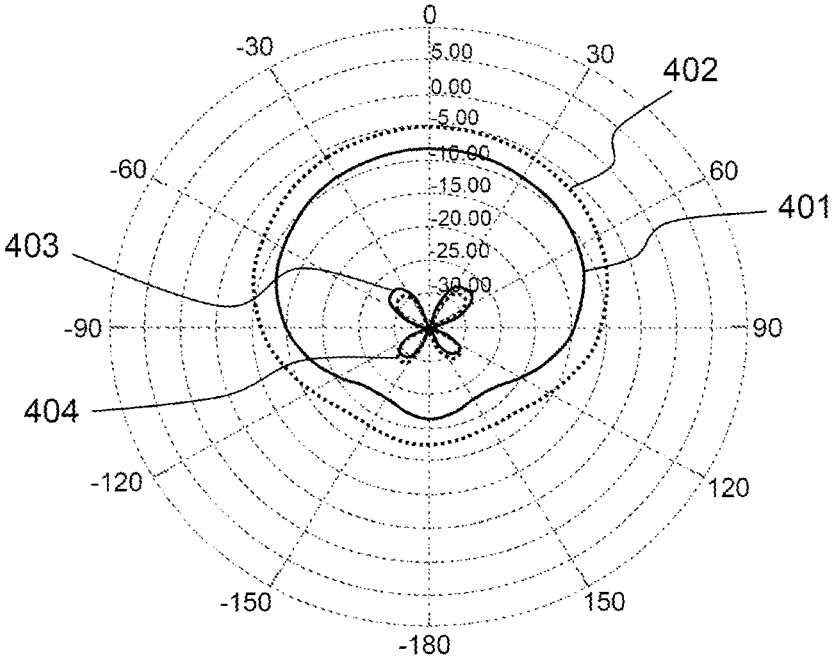
FIGS. 4*a* and 4*b* represent an example of radiation patterns of the input associated with the low frequency band of a radiating cell according to the first embodiment of the invention.
Figure 4B:
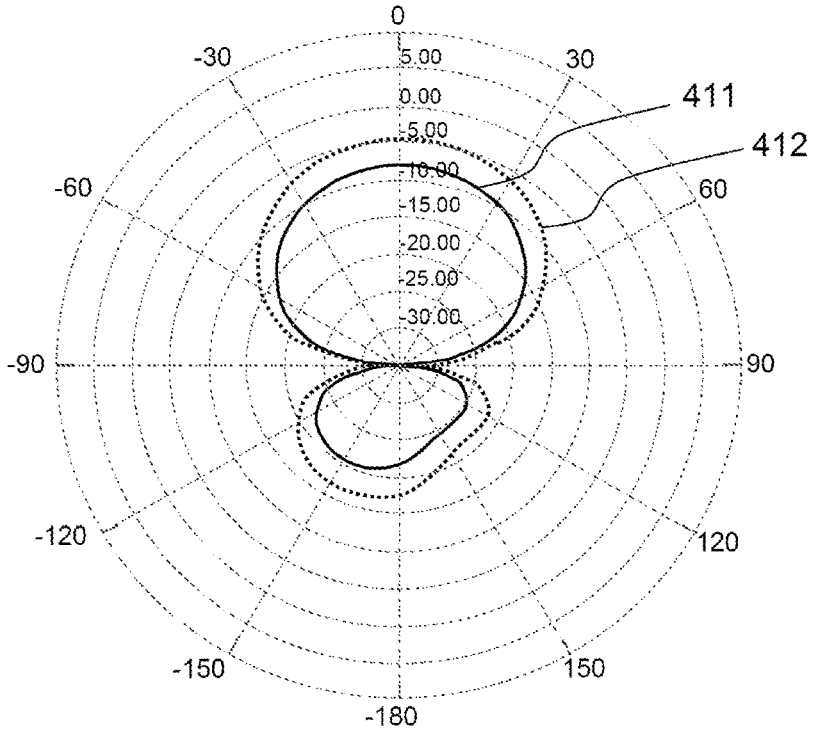

FIGS. 4*a* and 4*b* represent an example of radiation patterns of the input associated with the low frequency band of a radiating cell according to the first embodiment of the invention.

FIG. 4*a* represents the radiation pattern in the horizontal plane of the feed to the low frequency band, for a frequency of 1.03 GHz in principal polarization (401) and cross polarization (403), as well as for a frequency of 1.09 GHz in principal polarization (402) and cross polarization (404). The response according to the cross polarization in this plane is almost zero (−30 dB).

The principal polarization of a radiating element is the axis on which the radiated electric field is a maximum. The cross polarization is the axis perpendicular to the axis of the principal polarization. These two axes are situated in the plane perpendicular to the direction of propagation.

In the case of the device according to the invention, the principal polarization is situated in the vertical plane (represented by the y axis in the figures), while the cross polarization is situated in the horizontal plane (represented by the×axis in the figures).

FIG. 4*b* represents the radiation pattern in the vertical plane of the feed to the low frequency band, for a frequency of 1.03 GHz (411) and of 1.09 GHz (412). In this plane, the level of cross polarization is almost zero.

The radiation patterns observed on the feed to the low frequency band in the horizontal and vertical plane vary as cosine θ for the principal polarization, θ being the direction of observation. This characteristic is necessary for the production of an electronic-scanning antenna.

Figure 5A:
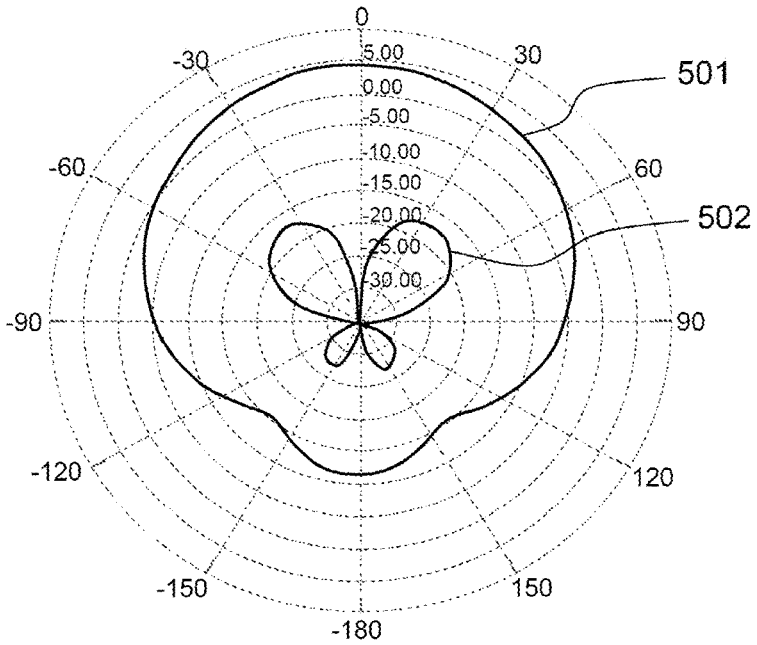
FIGS. 5*a* and 5*b* represent an example of radiation patterns of the input associated with the high frequency band of a radiating cell according to the first embodiment of the invention.
Figure 5B:
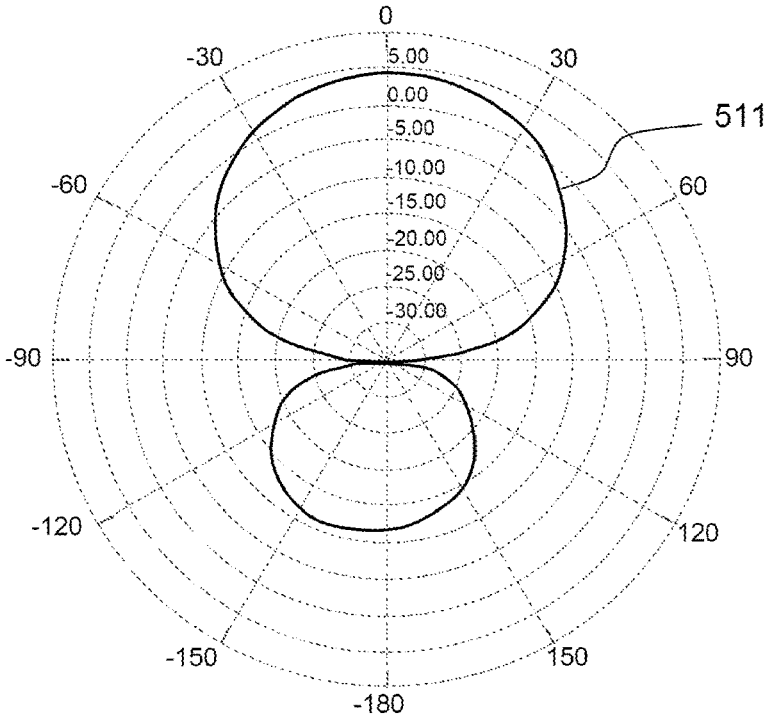

FIGS. 5*a* and 5*b* represent an example of radiation patterns of the input associated with the high frequency band of a radiating cell according to the first embodiment of the invention.

FIG. 5*a* represents the radiation pattern in the horizontal plane of the feed to the high frequency band, for a frequency of 2.9 GHz in principal polarization (501) and cross polarization (502). The response according to the cross polarization is weak with respect to the response according to the principal polarization (typically 15 dB to 30 dB difference).

FIG. 5*b* represents the radiation pattern in the vertical plane of the feed to the high frequency band, for a frequency of 2.9 GHz in principal polarization (511). The response in cross polarization in this plane is negligible.

The radiation patterns observed in the high frequency band are characteristic of the radiation pattern of a patch. Indeed, this pattern possesses a variation similar to a cosine function θ, necessary for the production of an electronic-scanning antenna.

Figure 6:
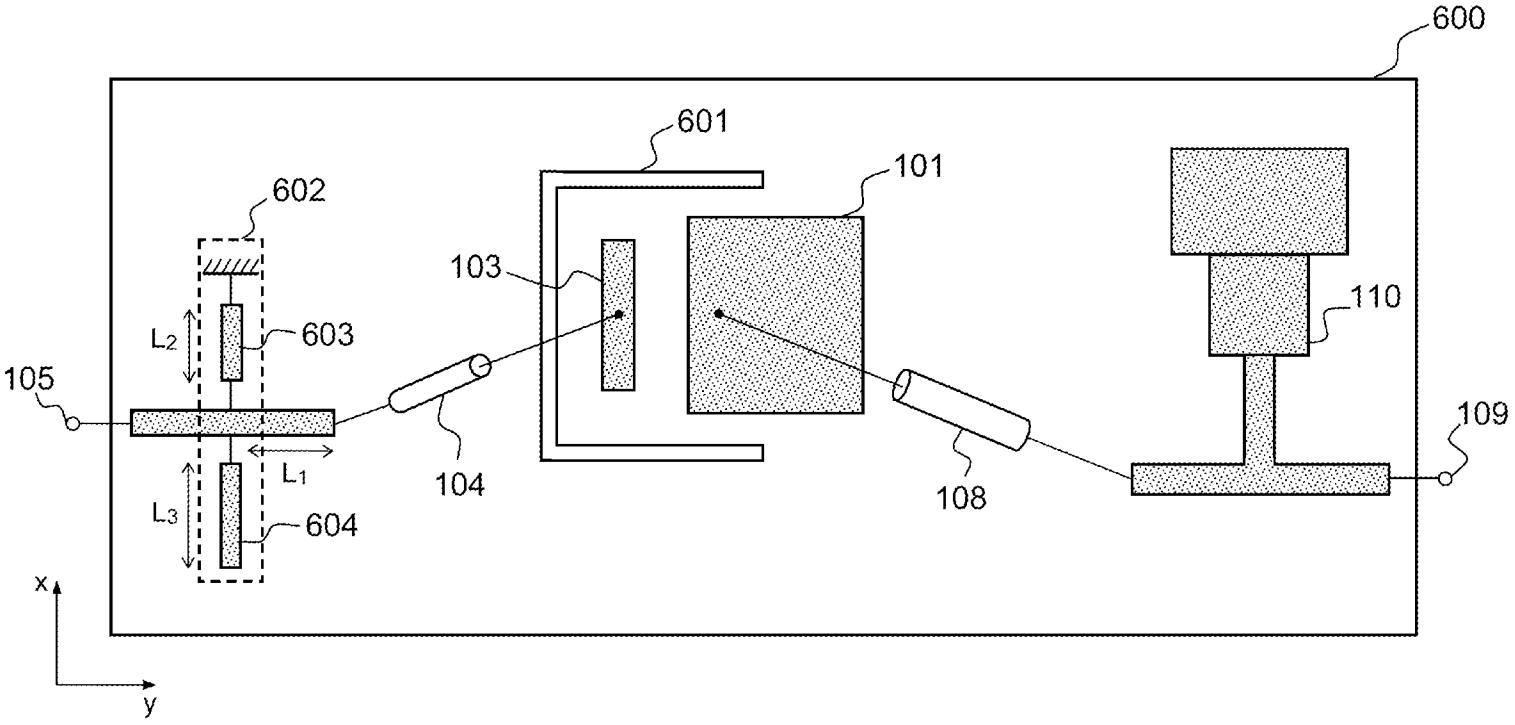
FIG. 6 represents a radiating cell according to a second embodiment of the invention.

FIG. 6 represents a radiating cell according to a second embodiment of the invention, This mode of operation limits the number of sub-bands in the low frequency band to two.

In a manner identical to the first embodiment, the radiating cell 600 designed according to the second embodiment of the invention comprises a radiating element 101 of patch type tuned to the upper frequency band. This radiating element is powered by the high band output 109 to which it is linked by way of a coaxial line 108 allowing it to pass through the various layers of the printed circuit, and of a filter 110 produced in the form of a stub exhibiting several segments of variable impedance, making it possible to filter the low frequency band while being passing for the high frequency band. Advantageously, a second element of patch type, identical to the first, can be overlaid on the first element of patch type 101, so as to widen the passband in the high frequency band.

The principal difference between this embodiment and the first consists in the fact that it contains only a unique element of slot type 601, folded into a U, and positioned so as to be unencumbered with respect to the masking that the patch or patches 101 represent. The operating band of this element is then widened to the whole of the low frequency band, so as to comprise the two sub-bands required by IFF applications, by the association of a resonator 602. The radiating slot, which forms a parallel resonator, can be supplemented with a series resonator placed in the output plane, or by a parallel resonator placed a quarter-wave further away. The resonator 602 is then placed at a distance $L_1$ from the connector 104 linking it to the exciter 103 of the slot, $L_1$ being equal to λ/4, where λ is the central wavelength of the low frequency band.

The slot 601 is not tuned to one of the sub-bands of the low frequency band, but to the central frequency, i.e. in the case of the chosen example, the frequency 1.06 GHz. It can also be tuned to a slightly higher frequency, so as to be compatible, once folded into three parts, with a mesh size at the high frequency. The resonator 602 is designed to resonate at the same frequency. The action on the coupling between these two elements, that is to say the mismatch created between these two elements, will make them resonate around the sought-after frequencies. The coupling between the two elements is adjusted by varying the position of the exciter 103 of the slot. The slot 601, the resonator circuit 602 and the exciter 103 are therefore dimensioned and positioned so that the whole resonates around the frequencies 1030 MHz and 1090 MHz, while permitting a large mismatch in the intermediate frequency zone. The radiating element thus obtained is dual-frequency. This approach offers the advantage of introducing only a single radiating slot into the cell, and of reducing the interference between the slot and the patch, and therefore the phenomena of coupling between the low frequency band and the high frequency band. The positioning of the slot 601 and of the exciter 103 is therefore simplified with respect to the first embodiment.

In FIG. 6, the resonator circuit 602 is of parallel capacitor and inductor type. The inductor 603 is of low value. It is produced in the form of a grounded microstrip line of length $L_2$. The capacitor 604 is produced in the form of a short-circuited microstrip line of length $L_3$, $L_3$ being much greater than $L_2$.

Advantageously, a low-pass filter similar to the filter 106 of the first embodiment of the invention can be added so as to filter the components of the high bands related to the coupling between the slot and the patch. Such a filter is, however, not indispensable in the second embodiment, the role of low-pass filter being carried out naturally by the resonator circuit.

In the second embodiment, the decrease in the number of radiating elements (slots) is compensated by an additional effort on the slot-matching microwave frequency circuit.

Figure 7A:
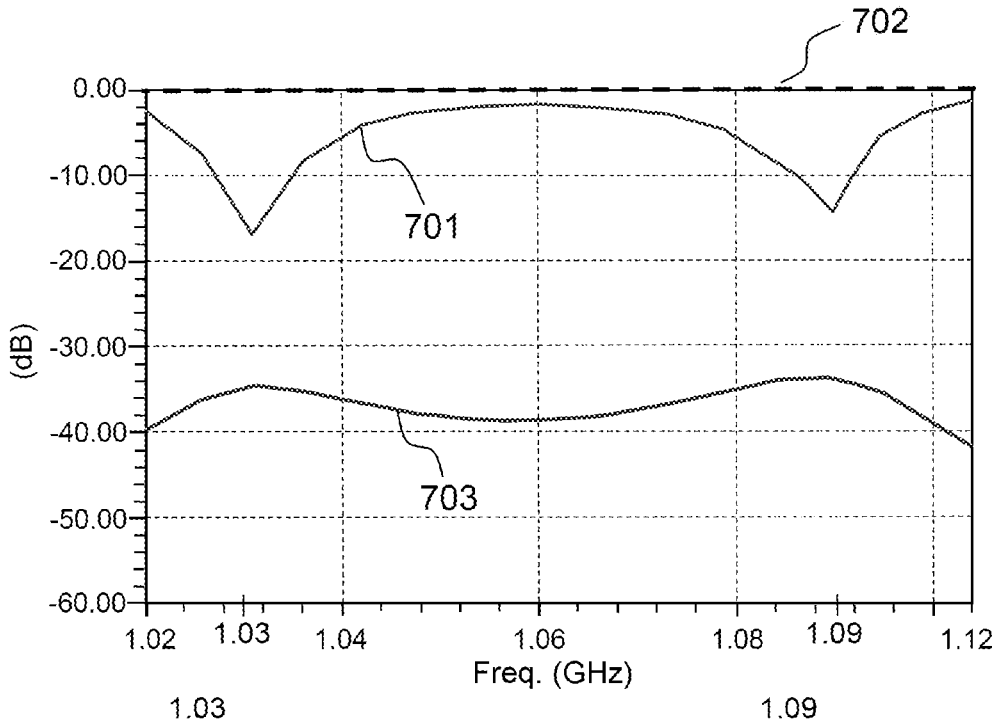
FIGS. 7*a* and 7*b* represent an example of coefficient of reflection of the inputs and of decoupling, respectively in the low frequency band and in the high frequency band and associated with each input of a radiating cell according to the second embodiment of the invention.
Figure 7B:
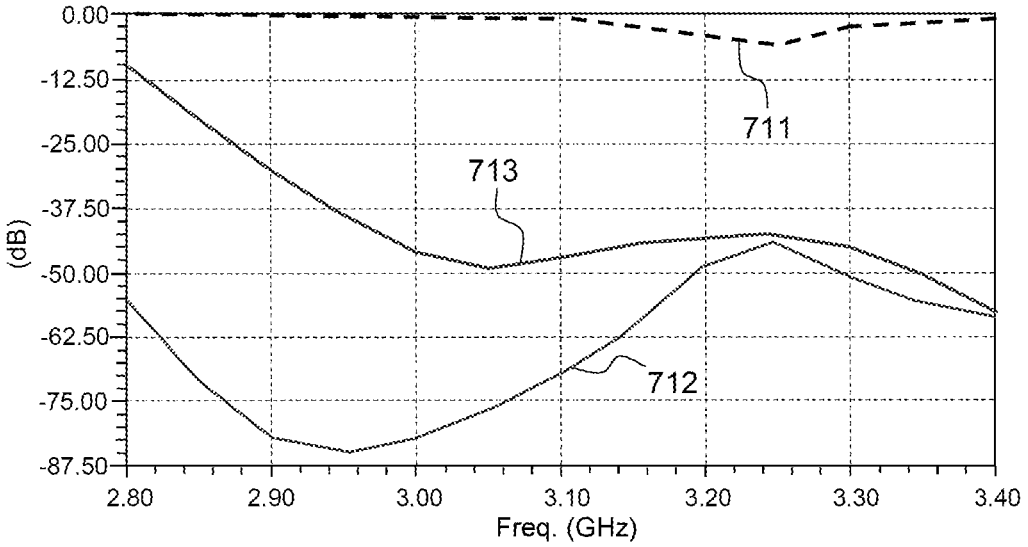

FIGS. 7*a* and 7*b* represent an exemplary coefficient of reflection and of decoupling associated with each input of a radiating cell according to the second embodiment of the invention. The results are obtained by simulations by means of a software package for electromagnetic simulation by the finite element method.

In FIG. 7*a*, curve 701 represents the coefficient of reflection of the feed dedicated to the low frequency band for the low frequency band (the frequency bands envisaged in this embodiment are bands of a few MHz or tens of MHz around the frequencies 1.03 GHz and 1.09 GHz). This coefficient is close to or less than −10 dB around the frequencies 1.03 GHz and 1.09 GHz. The feed dedicated to the low frequency band is therefore adapted to IFF applications.

Curve 702 represents the coefficient of reflection of the feed dedicated to the high frequency band, for the low frequency band. In the 1 GHz-1.15 GHz band, this coefficient is constant, and equals 1 (i.e. 0 dB). The feed dedicated to the high frequency band therefore rejects all the components of the low frequency band. It is not affected by the coupling with the radiating elements in the low frequency band. The decoupling 703 between the feeds of the slot and of the patch is of the order of 30 dB.

In FIG. 7*b*, curve 711 represents the coefficient of reflection of the feed dedicated to the low frequency band, for the high frequency band (the frequency band envisaged in this embodiment is the 2.9 GHz-3.3 GHz band). This coefficient is almost constant, and equals 1 (i.e. 0 dB) over almost the entire band. The feed dedicated to the low frequency band therefore rejects all the components of the high frequency band, it is not affected by the coupling with the radiating elements in the high frequency band.

Curve 712 represents the coefficient of reflection of the feed dedicated to the high frequency band. In the 2.9 GHz-3.3 GHz band, this coefficient is much less than −12.5 dB. The feed dedicated to the high frequency band is therefore adapted to this frequency band.

The decoupling 713 between the 2 antennas is greater than 12.5 dB in the band.

Figure 8A:
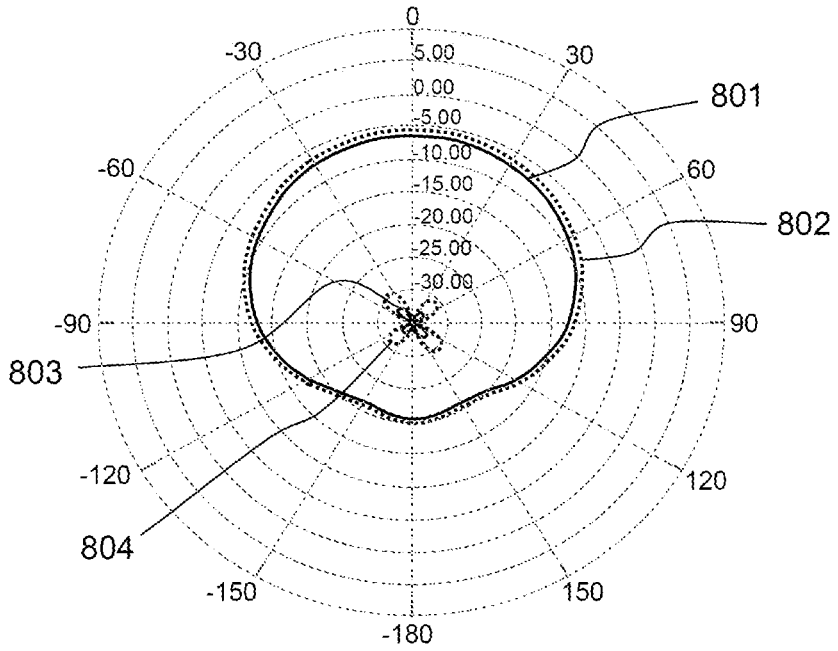
FIGS. 8*a* and 8*b* represent an example of radiation patterns of the input associated with the high frequency band of a radiating cell according to the second embodiment of the invention.
Figure 8B:
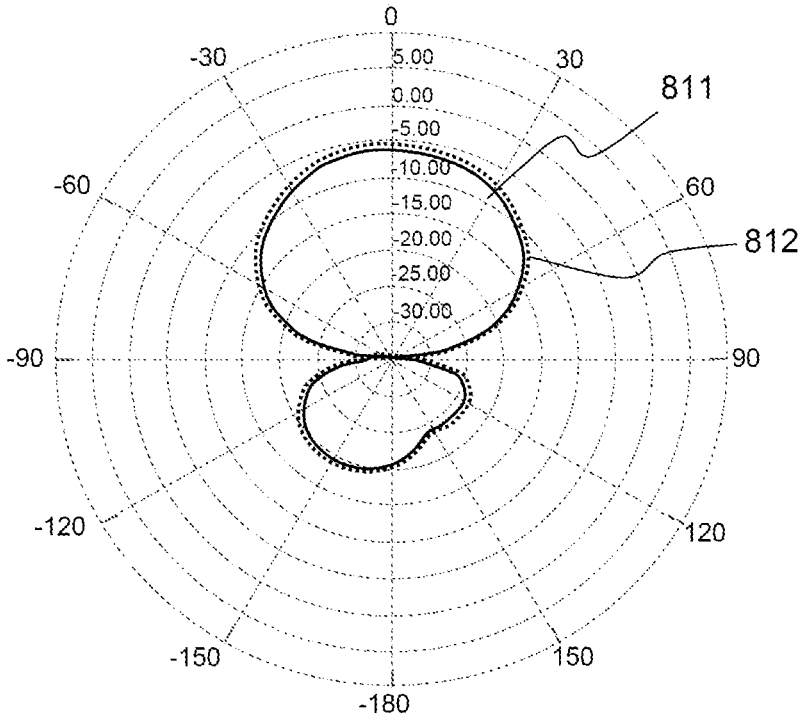

FIGS. 8*a* and 8*b* represent an example of radiation patterns of the input associated with the low frequency band of a radiating cell according to the second embodiment of the invention.

FIG. 8*a* represents the radiation pattern in the horizontal plane of the feed to the low frequency band, for a frequency of 1.03 GHz in principal polarization (801) and cross polarization (803), as well as for a frequency of 1.09 GHz in principal polarization (802) and cross polarization (804). The response according to the principal polarization in this plane is almost zero (−30 dB).

FIG. 8*b* represents the radiation pattern in the vertical plane of the feed to the low frequency band, for a frequency of 1.03 GHz in principal polarization (811), as well as for a frequency of 1.09 GHz in principal polarization (812). In this plane, the cross polarization is negligible.

The radiation patterns observed on the feed to the low frequency band in the first and second plane vary as cosine θ for the principal polarization, θ being the direction of observation. This characteristic is necessary for the production of an electronic-scanning antenna.

Figure 9A:
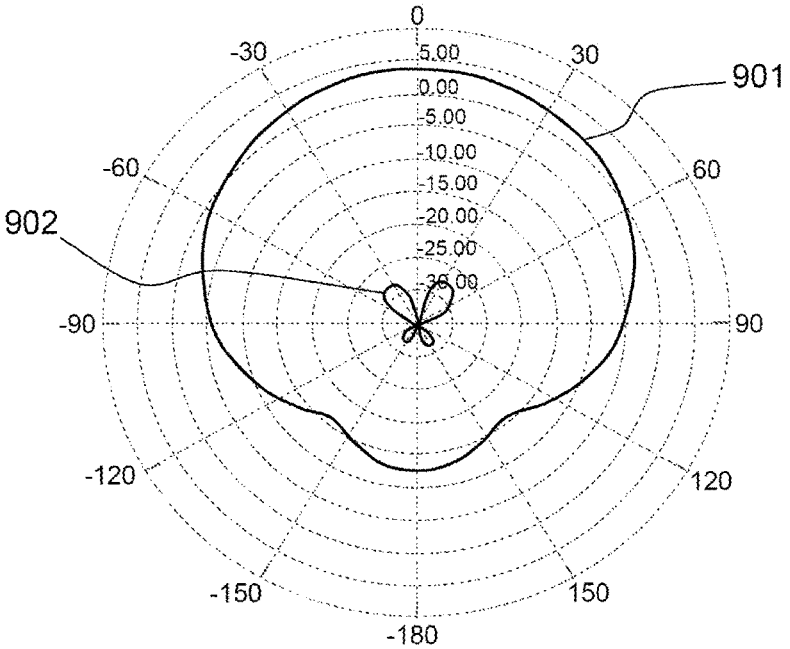
FIGS. 9*a* and 9*b* represent an example of radiation patterns of the input associated with the high frequency band of a radiating cell according to the second embodiment of the invention.
Figure 9B:
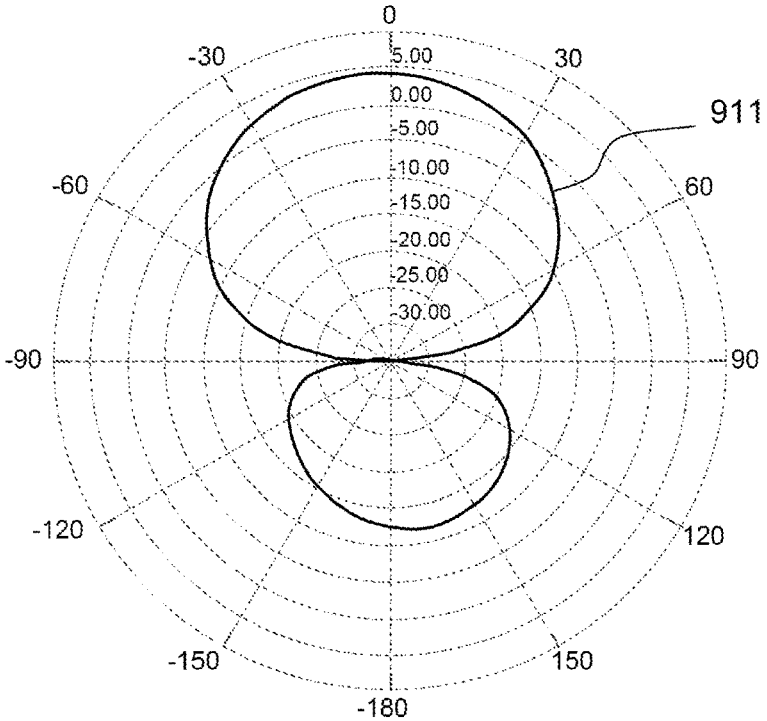

FIGS. 9*a* and 9*b* represent an example of radiation patterns of the input associated with the high frequency band of a radiating cell according to the first embodiment of the invention.

FIG. 9*a* represents the radiation pattern in the horizontal plane of the feed to the high frequency band, for a frequency of 2.9 GHz in principal polarization (901) and cross polarization (902). The response according to the cross polarization is weak with respect to the response according to the principal polarization (typically 30 dB of difference).

FIG. 9*b* represents the radiation pattern in a vertical plane of the feed to the high frequency band, for a frequency of 2.9 GHz in principal polarization (911). There is no response in cross polarization in this plane of the cell.

The radiation patterns observed in the high frequency band are characteristic of the radiation pattern of a patch. Indeed, this radiation pattern in the first plane possesses a cosine θ variation characteristic of a patch antenna, and necessary for the production of an electronic-scanning antenna.

Figure 10:
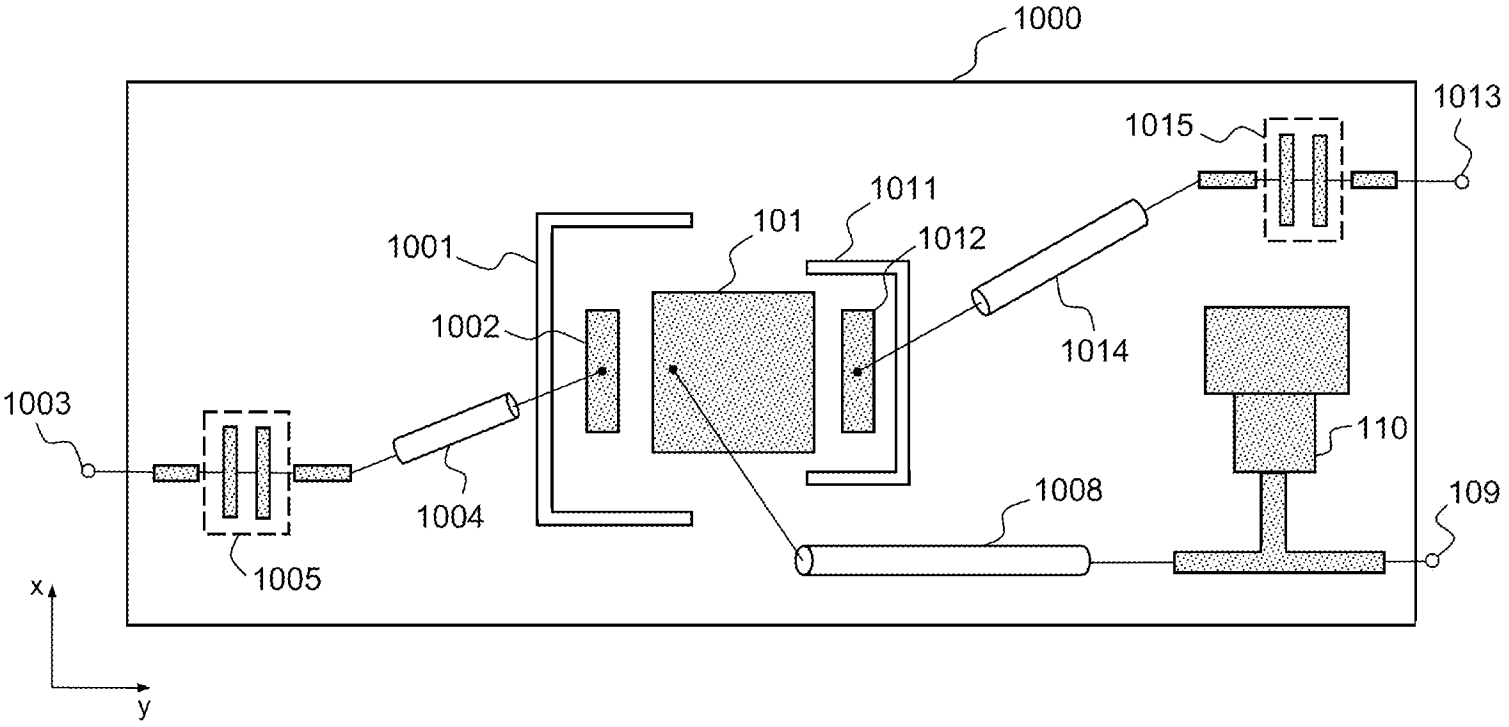
FIG. 10 represents a radiating cell according to a third embodiment.

FIG. 10 represents a radiating cell according to a third embodiment of the invention. This is a variant of the first embodiment, which comprises a radiating element of slot type for each of the sub-bands envisaged in the low frequency band.

This embodiment differs from the first in that the two elements of slot type 1001 and 1011 are dissociated and placed on each side of the element of patch type, still at the periphery of the radiating cell so as not to be masked by the patch. This separation between the two slots makes it possible to reduce the phenomena of coupling between them. Each of the slots is tuned with respect to the central frequency of one of the sub-bands of the low frequency band, or brought back to this frequency by coupling. Finally, each of the slots is linked to a distinct feed. The radiating cell then has three feeds: a first feed to the high frequency band, and a feed for each of the sub-bands of the low frequency band.

In this embodiment, the first slot 1001 is powered by the feed 1003 to which it is linked by way of an exciter 1002, of a coaxial line 1004, and of a low-pass filter 1005.

In an entirely identical manner, the second slot 1011 is powered by the feed 1013 to which it is linked by way of an exciter 1012, of a coaxial line 1014, and of a low-pass filter 1015.

The invention also comprises a radiating array produced on the basis of dual-band radiating cells such as defined above. Each of the cells can then be driven in amplitude and/or in phase in each of the bands of interest, i.e. in the specific example, in the S band (and more particularly the 2.9 GHz-3.3 GHz sub-band) and in the band dedicated to IFF applications (1.03 GHz and 1.09 GHz).

It consists finally of a dual-band radar comprising a single electronic-scanning antenna, the antenna being produced on the basis of the radiating array described hereinabove, and operating independently in the two frequency bands.

The invention claimed is:

1. A radiating device operating in two distinct frequency bands, a high frequency band and at least one sub-band of a low frequency band, the said device comprising:

at least one element of patch type adapted to the high frequency band and linked to a first feed, at least one element of folded slot type, adapted to the low frequency band and linked to a second feed different from the said first feed, a filter positioned between the said element of patch type and the said first feed, configured to filter the low frequency band and to be passing for the high frequency band, and wherein the elements of which it consists are positioned in a surface area of less than or equal to a square of edge $\lambda/2$, where $\lambda$ is the wavelength corresponding to the maximum frequency of the high frequency band.

2. The radiating device according to claim 1, wherein the element of slot type is accommodated in a ground plane of the device.

3. The radiating device according to claim 1, wherein the element or elements of folded slot type are folded into a U shape and positioned at the periphery of the device.

4. The radiating device according to claim 1, wherein the number of elements of slot type is equal to the number of sub-bands of the low frequency band, the elements of slot type being powered by one and the same second feed.

5. The radiating device according to claim 1, wherein the number of elements of slot type is equal to the number of sub-bands of the low frequency band, the elements of slot type being powered by different feeds.

6. The radiating device according to claim 1, comprising a single element of slot type powered by the second feed to which it is linked by a resonator circuit, the coupling between the slot and the resonator circuit being adjusted to radiate in two distinct sub-bands of the low frequency band.

7. The radiating device according to claim 6, wherein the resonator circuit is a parallel resonator circuit comprising an inductor and a capacitor, the resonator being linked to the element of slot type by a waveguide of length $\lambda/4$, where $\lambda$ is the wavelength associated with the central frequency of the low frequency band.

8. The radiating device according to claim 1, wherein the filter positioned between the element of patch type and the first feed comprises a plurality of segments of microstrip line of different widths.

9. The radiating device according to claim 1, further comprising a low-pass filter positioned between the element or elements of slot type and the said second feed, and configured to filter the high frequency band.

10. The radiating device according to claim 1, further comprising a second element of patch type adapted to the high frequency band, the second element of patch type being disposed above the first element of patch type.

11. The radiating device according to claim 1, implemented in a multilayer printed circuit for which the element of patch type, the element or elements of slot type, and the filter positioned between the element of patch type and the first feed are in different layers of the printed circuit.

12. The radiating device according to claim 11, wherein at least one frequency of the high frequency band is an odd integer multiple of a frequency of the low frequency band.

13. The radiating device according to claim 12, wherein the high frequency band comprises the 2.9 GHz-3.3 GHz band.

14. The radiating device according to claim 1, wherein a sub-band of the low frequency band is centred around a frequency chosen from among the frequency 1030 MHz and the frequency 1090 MHz.

15. The radiating device according to claim 1 produced using printed technology.

16. A radiating array configured to radiate in two distinct frequency bands, comprising radiating devices according to claim 1.

17. Electronic scanning radar configured to operate simultaneously in two different frequency bands, and comprising a radiating array according to claim 16.

* * * * *